US008459519B2

(12) United States Patent
Feng et al.

(10) Patent No.: US 8,459,519 B2
(45) Date of Patent: Jun. 11, 2013

(54) HIGH-SPEED ELECTROMAGNETIC NAIL GUN

(75) Inventors: Zezhou Feng, Beijing (CN); Yue Fan, Beijing (CN); Zhiwen Liao, Beijing (CN)

(73) Assignee: Beijing Dafeng Technology Ltd., Beijing (CN)

( * ) Notice: Subject to any disclaimer, the term of this patent is extended or adjusted under 35 U.S.C. 154(b) by 330 days.

(21) Appl. No.: 13/000,018

(22) PCT Filed: Jun. 15, 2009

(86) PCT No.: PCT/CN2009/072266

§ 371 (c)(1),
(2), (4) Date: Dec. 19, 2010

(87) PCT Pub. No.: WO2009/152752

PCT Pub. Date: Dec. 23, 2009

(65) Prior Publication Data

US 2011/0095066 A1 Apr. 28, 2011

(30) Foreign Application Priority Data

Jun. 20, 2008 (CN) ..... 2008 1 0115277

(51) Int. Cl.
*B25C 1/06* (2006.01)

(52) U.S. Cl.
USPC ..... 227/131; 227/132; 227/156

(58) Field of Classification Search
USPC ..... 227/131, 132, 156
See application file for complete search history.

(56) References Cited

U.S. PATENT DOCUMENTS

| | | | | |
|---|---|---|---|---|
| 3,552,627 | A * | 1/1971 | Moreno | 227/121 |
| 6,722,547 | B1 * | 4/2004 | Wang et al. | 227/8 |
| 6,830,173 | B2 * | 12/2004 | Barber et al. | 227/131 |
| 7,637,408 | B2 * | 12/2009 | Takahashi et al. | 227/133 |
| 8,210,409 | B2 * | 7/2012 | Hirabayashi | 227/131 |
| 8,240,534 | B2 * | 8/2012 | Hirabayashi | 227/131 |
| 2006/0180631 | A1 * | 8/2006 | Pedicini et al. | 227/130 |
| 2008/0061105 | A1 * | 3/2008 | Zachrisson et al. | 227/131 |
| 2008/0179371 | A1 * | 7/2008 | Gardner et al. | 227/1 |
| 2008/0257933 | A1 * | 10/2008 | Takahashi et al. | 227/129 |

* cited by examiner

*Primary Examiner* — Brian D Nash

(57) ABSTRACT

An electromagnetic nail gun with a lever, comprising a handle for holding the nail gun and triggering the operation of the nail gun, an electromagnetic lever driving device for driving nails with variable speeds through the movement of the lever, wherein electromagnetism is used as driving force, a firing pin slideway for allowing the lever to move therein, and a muzzle magazine assembly for loading nails inside. The present invention uses the magnetism as driving force directly and then applies the lever and variable speed drive to launch nails. Therefore, the structure of the present invention is very simple, light, the manufacture cost is decreased drastically, vibration and noise when used are quite little, very convenient to operate, dispense with the air compressor, easy to carry around.

9 Claims, 2 Drawing Sheets

HIGH-SPEED ELECTROMAGNETIC NAIL GUN

BACKGROUND

1. Field of the Invention

The present invention pertains to a high-speed electromagnetic nail gun with a lever.

2. Description of Related Arts

Pneumatic nail guns are applied widely in fields of construction, renovation, furniture manufacture, advertisement decoration and so on. Currently, the most commonly used driving force for nail guns is compressed air. By compressing air to power an air hammer and drive nails into wall or wood, the purpose of fastening two things together can be accomplished. However, these type of pneumatic nail guns have the disadvantages of being complicated, heavy, expensive to manufacture, high cost, vibrating when used, noisy and etc. not only, but also needs to be equipped with a compressor, a pressure adjustment and gas control device, and pipes and connector assembly that are used for connecting the nail gun and the compressor; therefore, it leads to high cost and inconvenience; moreover, when operating the nail gun, the users have to carry those pipes around. Besides, because the nail gun converts electrical energy into the potential energy of the compressed air and then converts the potential energy of the compressed air into kinetic energy, the double energy conversions bring low energy efficiency.

SUMMARY OF THE INVENTION

The objective of the present invention is to furnish a high-speed electromagnetic nail gun with a lever, which uses electromagnetism as the driving force and drives the firing spin, with variable speeds, through the lever to launch nails. The present invention has the following advantages: simple structure, lightweight, low manufacture cost, little vibration and noise when used, convenient operation, without air compressor accessories, and excellent performance.

According to the present invention, the electromagnetic nail gun with a lever comprises a handle for holding the nail gun and triggering the operation of the nail gun, an electromagnetic lever driving device for driving nails with variable speeds through the movement of the lever, a firing pin slideway for allowing the lever to move therein and a muzzle magazine assembly for loading nails inside.

The upper end of the handle and the lower end of the lever base are connected; the handle is hollow; a handle case is provided outside the handle. A micro-switch for switching on and off the power supply of electromagnetic coils is provided inside the handle; the trigger of the micro-switch is exposed at the upper end of the front part of the handle. The electromagnetic lever driving device comprises a lever base, a coil frame, electromagnetic coils, an iron core, a core linkage, a reset spring connecting member, a lever and a reset spring. The lever base is located at the upper end of the handle; the coil frame is located at the front part of the lever base and is winded with electromagnetic coils. The iron core is inside the electromagnetic coils; the rear part of the iron core is connected through the core linkage and a connecting sheet with the middle hole of the lever, and the middle hole is connected through a reset spring connecting member with a suspension beam, and the suspension beam is connected with the right end of the reset spring. The other end of the reset spring is fixedly connected on a spring base; the reset spring is set in between the spring base and the suspension beam; the lower end of the lever is hinged on the lever base; the upper end of the lever is located inside the firing pin slideway. The firing pin slideway is set at the upper end of the lever base; the lower front of the firing pin slideway is connected fixedly with the upper end of the lever base, which is located at the upper end of the electromagnetic coils; there is a firing pin slide block provided in the slideway; the upper end of the lever is inside the firing pin slide block; the front end of the firing pin slide block is connected with the back end of the firing pin; the front end of the firing pin passes through a shock absorption cushion that is located at the front of the firing pin slideway; the shock absorption cushion is located at the upper part of the muzzle magazine assembly; the muzzle magazine assembly is located at the front end of the handle; the upper back of the muzzle magazine assembly is fixedly connected via the frond end of the firing pin slideway with the upper end of the lever base; the place where nails is launched from and loaded to the muzzle magazine assembly is within the stroke of the firing pin.

The present invention utilizes directly electromagnetic as the driving force, drives the firing pin by virtue of a lever to launch nails with variable speeds. As a result, the nail gun of the present invention is simple structure, lightweight, low manufacture cost, less vibration and noise, convenient operation, without any air compressor accessories, easy to carry it around. Compared to the pneumatic nail gun, when the launching effect is the same, the present invention has faster launching speed, and the manufacture cost is decreased by 60%.

The reference numbers are as follow. 1—coil frame; 2—iron core; 3—firing pin slideway; 4—connecting sheet for connecting the iron core and the lever; 5—firing pin slide block; 6—firing pin; 7—firing pin peg; 8—muzzle magazine assembly; 9—handle; 10—handle case; 11—trigger; 12—micro-switch; 13—roller pin; 14—slideway cover; 15—Lever; 16—magnetic conducting sleeve; 17—lever base; 18—core linkage; 19—shock absorption cushion; 20—roller washer; 21—spring base; 22—reset spring connecting member; 24—suspension beam; 25—pin for connecting the lever 15, connecting sheet 4 and reset spring connecting member 22; 26—hinge pin; 27—pin; 28—reset spring; 29—electromagnetic coils; 30—iron core pin.

DETAILED DESCRIPTION OF THE PREFERRED EMBODIMENTS

Figure 1:
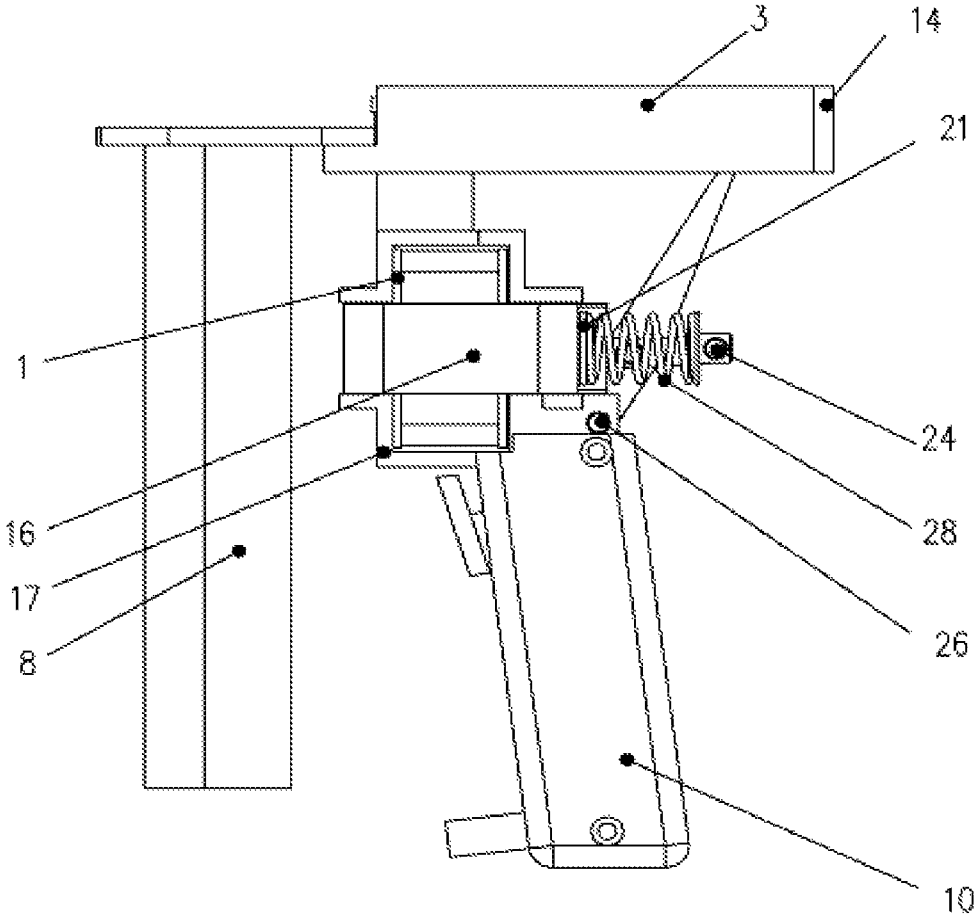
FIG. 1 is a schematic diagram of the exterior structure of the present invention.
Figure 2:
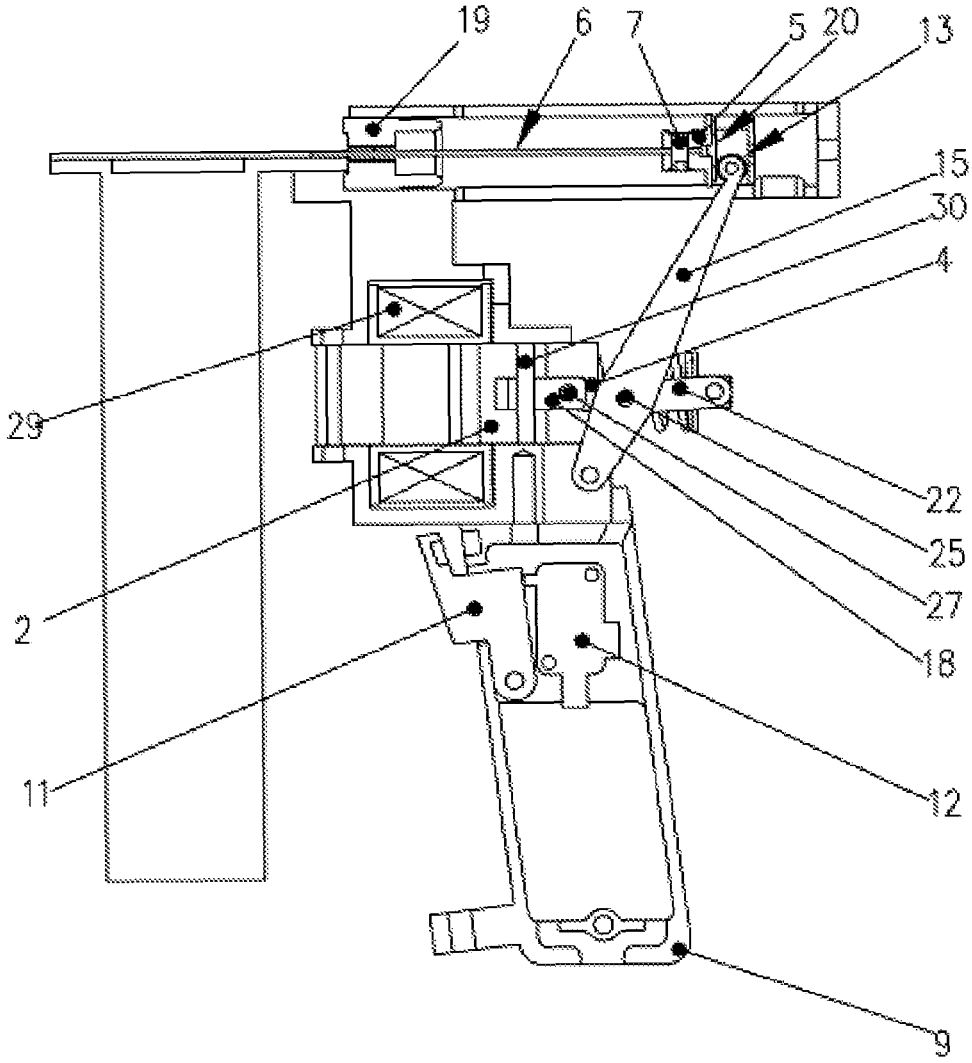
FIG. 2 is a schematic structural diagram.

As shown in FIG. 1 and FIG. 2, a high-speed electromagnetic nail gun mainly comprises a handle 9, an electromagnetic lever driving device, a firing pin slideway 3 and a muzzle magazine assembly 8.

The upper end of the handle 9 and the lower end of the lever base 17 are connected. The handle 9 is hollow, so that the control circuit board can be set inside. A handle case 10 is provided outside the handle, which encloses all electronic components that are in the handle inside it. A micro-switch 12 for switching on and off the power supply of electromagnetic coils 29 is provided inside the handle. The trigger 11 of the micro-switch is exposed on the upper end of the front part of the handle 9; the trigger is for pressing the switch button of the micro-switch.

The electromagnetic lever driving device comprises a lever base 17, a coil frame 1, electromagnetic coils 29, an iron core 2, a core linkage 18, a reset spring connecting member 22, a lever 15 and a reset spring 28. The lever base 17 is located at the upper end of the handle 9; the frame 1 is located at the front part of the lever base 17; the coil frame 1 is winded with electromagnetic coils 29; the iron core 2 is set inside the electromagnetic coils 29. In between the electromagnetic coils 29 and the iron core 2 is set a magnetic conducting sleeve 16, which is for conducting magnetism and guiding the iron core 2 to move left and right inside it. The rear part of the iron core 2 is connected through an iron core pin 30 with the core linkage 18; the rear end of the core linkage 18 is connected through a pin 27 with the front part of a connecting sheet 4; the rear end of the connecting sheet 4 is connected with the middle hole of the lever 15; the middle hole of the lever is connected through a reset spring connecting member 22 with the a suspension beam 24, and then the suspension beam is connected with the right end of the reset spring 28, wherein this end of the reset spring can move leftward under the pulling of the iron core 2. The other end of the reset spring 28 is connected to a spring base 21, wherein this end of the reset spring is fixed. The reset spring 28 is set in between the spring base 21 and the suspension beam 24. When the iron core 2 moves leftward, the lever 15 can be brought to move together through the core linkage 18 and the connecting sheet 4; then, the middle hole of the lever 15, through the reset spring connecting member 22, pulls and presses the reset spring 28; because the other end of the reset spring is connected to the spring base 21 and is fixed, the spring can be pressed greatly. When the reset spring starts to reset, it will bring all above-described parts move back to their original places. The lower end of the lever 15 is hinged on the lever base 17, which is located at the lower end of the front part of the reset spring connecting member 22, through a hinge pin 26; the other end of the lever 15, the upper end, is located in the firing pin slideway 3.

The firing pin slideway 3 takes on the shape of Π and is located at the upper end of the lever base 17. An opening or a through slot is formed on the bottom end face of the firing pin slideway 3 for the upper end of the lever 15 to move in it. The lower part of the front end of the firing pin slideway 3 is connected fixedly with the upper end of the lever base 17. There is a firing pin slide block 5 provided in the slideway. A roller and a roller pin 13 are installed at the upper end of the lever 15 and are set in the sliding block 5. A roller washer 20 is set on the contact face of the roller and the firing pin slide block for the roller to roll in the firing pin slide block. The front end of the firing pin slide block 5 is connected with the back end of the firing pin 6 through a firing pin peg 7. The front end of the firing pin 6 passes through a shock absorption cushion 19, which is located at the front end of the firing pin slideway 3, and the upper part of the muzzle magazine assembly 8. The shock absorption cushion 19 is made of durable rubber or plastic and for guiding the firing pin and shock absorption. The rear end of the firing pin slideway is closed by a slideway cover 14.

The muzzle magazine assembly 8 is located at the front end of the handle 9. The upper back of the muzzle magazine assembly is fixedly connected via the front end of the firing pin slideway 3 with the upper end of the lever base 17; the place where nails is launched from and loaded to the muzzle magazine assembly is within the stroke of the firing pin. The ratio of the stroke of the iron core to the stroke of the firing pin is 1:3-1:8. Since there are various general-purpose muzzle magazine assemblies available in the market, such as those for normal-shaped nails or those for U-shaped staples, to meet different requirements of the shape of the nails, the muzzle magazine assembly can be detached and be replaced with another one; for example, if U-shaped staples are required, what needs to do is just replace the current muzzle magazine assembly, which might be designed especially for the normal T-shaped nails, with the another muzzle magazine assembly that is designed especially for the U-shaped staples. All these variations are fallen into the present invention.

During operation, hold the handle 9 by hand, turn on the power supply, and press the trigger 11 to trigger the micro-switch 12, trigger the control circuit of the circuit board, and turn on the power supply of the electromagnetic coils 29. Next, the electromagnetic coils 29 generate magnetic force to attract the iron core 2 toward left rapidly, and then the iron core 2 brings the lever 15 move through the core linkage 18. The upper end of the lever 15 speeds up and brings the firing pin slide block 5 to move, so that the front end of the firing pin 6 strikes the nails forward that are loaded in the muzzle magazine assembly 8 and drives them into a certain fixed thing. In the meantime, the reset spring 28 that is located at the reset spring connecting member 22 is compressed in between the spring base 21 and the corresponding lever base 17.

When the trigger 11 is released, the micro-switch 12 is powered off, then the electromagnetic coils 29 are powered off as well; therefore, the iron core 2 loses its magnetic suction. With the stretching action of the reset spring 28, the iron core 2 moves right, which further brings the lever 15, the firing pin slide block 5, and the firing pin 6 back to their original places successively, and accordingly accomplishes the action of launching nails.

To sum up, the present invention uses the magnetism as driving force directly and then applies the lever and variable speed drive to launch nails. Therefore, the structure of the present invention is very simple, light, the manufacture cost is decreased a lot, vibration and noise when used are quite little, very convenient to operate, dispense with the air compressor, easy to carry around.

The objective of the present invention has been fully and effectively accomplished. Its embodiments have been shown and described for the purpose of illustrating the functional and structural principles of the present invention and is subject to change without departure from such principles. Therefore, this invention includes all modifications encompassed within the spirit and scope of the following claims.

What is claimed is:

1. A electromagnetic nail gun with a lever, comprising:

a handle for holding the nail gun and triggering operation of the nail gun;

an electromagnetic lever driving device for driving nails with variable speeds through the movement of the lever, wherein electromagnetism is used as driving force;

a firing pin slideway for allowing the lever to move therein; and a muzzle magazine assembly for loading nails inside, wherein the electromagnetic lever driving device comprises a lever (15), a lever base (17), a coil frame (1), electromagnetic coils (29), an iron core (2), a core linkage (18), a reset spring (28), and a reset spring connecting member (22);

the lever base (17) is located at the upper end of the handle (9);

the coil frame (1) is located at the front part of the lever base (17) and is winded with the electromagnetic coils (29);

the iron core (2) is inside the electromagnetic coils (29);

the rear part of the iron core (2) is connected through the core linkage (18) and a connecting sheet (4) with the middle hole of the lever (15), and the middle hole of the lever is connected through a reset spring connecting member (22) with a suspension beam (24), and the suspension beam (24) is connected with the right end of the reset spring (28);

the other end of the reset spring is connected fixedly to a spring base (21);

the reset spring (28) is set in between the spring base (21) and the suspension beam (24);

the lower end of the lever (15) is hinged on the lever base (17);

the upper end of the lever base (17) is located in the firing pin slideway (3).

2. The electromagnetic nail gun with a lever recited in claim 1, wherein the upper end of the handle (9) and the lower end of the lever base (17) are connected;

the handle is hollow;

a handle case (10) is provided outside the handle;

a micro-switch (12) for switching on and off the power supply of electromagnetic coils is provided inside the handle;

a trigger (11) of the micro-switch is exposed at the upper end of the front part of the handle.

3. The electromagnetic nail gun with a lever recited in claim 2, wherein the ratio of the stroke of the iron core to the stroke of the firing pin is 1:3-1:8.

4. The electromagnetic nail gun with a lever recited in claim 1, wherein the firing pin slideway (3) takes on the shape of Π and is located at the upper end of the lever base (17);

the lower front of the firing pin slideway (3) is connected fixedly with the upper end of the lever base (17), which is located at the upper end of the electromagnetic coils (29);

a firing pin sliding block (5) is provided in the slideway;

the upper end of the lever (15) is inside the firing pin sliding block (5);

the front end of the firing pin sliding block is connected with the back end of the firing pin (6);

when launching nails, the front end of the firing pin can (6) pass through a shock absorption cushion (19) that is located at the front end of the firing pin slideway (3) and through the upper part of the muzzle magazine assembly (8).

5. The electromagnetic nail gun with a lever recited in claim 4, wherein the ratio of the stroke of the iron core to the stroke of the firing pin is 1:3-1:8.

6. The electromagnetic nail gun with a lever recited in claim 1, wherein the muzzle magazine assembly (8) is located at the front end of the handle (9);

the upper back of the muzzle magazine assembly (8) is fixedly connected via the front end of the firing pin slideway (3) with the upper end of the lever base (17);

the place where nails is launched from and loaded to the muzzle magazine assembly is within the stroke of the firing pin.

7. The electromagnetic nail gun with a lever recited in claim 6, wherein the ratio of the stroke of the iron core to the stroke of the firing pin is 1:3-1:8.

8. The electromagnetic nail gun with a lever recited in claim 1, wherein the ratio of the stroke of the iron core to the stroke of the firing pin is 1:3-1:8.

9. The electromagnetic nail gun with a lever recited in claim 1, wherein the muzzle magazine assembly also fits U-shaped staples.

* * * * *